US007001319B1

(12) United States Patent
Stanton

(10) Patent No.: US 7,001,319 B1
(45) Date of Patent: Feb. 21, 2006

(54) CANDY BOX CONSTRUCTION AND METHOD

(76) Inventor: Steven W. Stanton, 54 Navy St., Venice, CA (US) 90291

( * ) Notice: Subject to any disclaimer, the term of this patent is extended or adjusted under 35 U.S.C. 154(b) by 0 days.

(21) Appl. No.: 10/720,435

(22) Filed: Nov. 24, 2003

Related U.S. Application Data

(63) Continuation-in-part of application No. 10/456,036, filed on Jun. 5, 2003.

(51) Int. Cl.
*B31B 1/62* (2006.01)

(52) U.S. Cl. ..... 493/128; 493/150

(58) Field of Classification Search ..... 493/128, 493/130, 131, 150, 151
See application file for complete search history.

(56) References Cited

U.S. PATENT DOCUMENTS

| | | | | |
|---|---|---|---|---|
| 3,610,510 | A * | 10/1971 | Lowry | 229/116.2 |
| 4,084,489 | A * | 4/1978 | Matovich, Jr. | 493/129 |
| 4,195,394 | A * | 4/1980 | Semon | 27/10 |
| 5,400,917 | A * | 3/1995 | Stanton | 220/612 |
| 5,876,502 | A * | 3/1999 | Sugimura et al. | 118/712 |
| 5,950,835 | A * | 9/1999 | Moser et al. | 206/586 |
| 6,021,904 | A * | 2/2000 | Kozol et al. | 206/724 |
| 6,673,152 | B1 * | 1/2004 | Guzzon et al. | 118/315 |

* cited by examiner

*Primary Examiner*—Eugene Kim
(74) *Attorney, Agent, or Firm*—Lawrence S. Cohen

(57) ABSTRACT

A method of making a candy box by forming a side element and placing inside it a closure element, depositing a single glue fillet or a plurality of spaced-apart glue fillets in the interior corner defined by them.

10 Claims, 8 Drawing Sheets

CANDY BOX CONSTRUCTION AND METHOD

RELATED APPLICATIONS AND PATENTS

This application is a continuation-in-part of application Ser. No. 10/456,036 filed on Jun. 5, 2003 the content of which is incorporated herein by reference.

FIELD OF THE INVENTION

The invention relates to decorative boxes in particular to a decorative box and a method of making a decorative box of the type made from paper products and in further particular relating to candy boxes.

BACKGROUND OF THE INVENTION

Typically decorative boxes such as candy boxes are made of a paper board material and are covered with decorative paper. They comprise a box body having a side element and a closure at the bottom, and a cover with a side element and a closure at the top. The sides are formed with bends, corners and the closures conform to the shape of the sides. Covers may be fully removable or hinged in some manner such as by a paper hinge. Boxes vary in durability and purpose; the strength of the materials and the construction method used varies depending on the desired durability and purpose. To form corners, the structural element may be scored and bent to define a sharp corner. To form curves the structural element is bent into a curve of the desired shape without exceeding the bending strength of the material. Usually the ends of a continuous side element will meet at a place where there is to be a corner or sharp turn in the shape.

A particular field of boxes is candy boxes. These are made to survive the journey to the customer (subject to careful handling) with their decorative features intact and from then only need to last a short time until the candy is consumed. The particular materials and ruggedness of construction required for candy boxes is well known in the field. An especially popular type of candy box is the heart shaped box used in great quantities for the Valentines Day holiday.

Cost is an important factor which is manifest in both the material cost and the labor cost including the adaptation of automation to make the boxes.

Typically the structural elements will be glued together; although it is possible to join the elements by means of a decorative paper cover extending from one structural element to the other. Sometimes both means are used, together.

In a large box of this type, greater strength is needed in joining the structural elements such as the side element and the bottom closure. Also, some boxes shapes have portions of the side element bent inwardly convexly or concavely to form a shape. This bending inwardly creates a tendency to straighten, that is to unbend. Therefore there is a need to have a construction and method, which will strongly hold all the parts together against the tendency to straighten.

One solution to this problem is seen in U.S. Pat. No. 5,400,917. In that patent there is disclosed a three layer bottom closure assembly for the bottom of the box, which can also be used for the box cover. The exterior layer of the three layers is made of lightweight board suitable for the desired appearance and strength of the box. The interior layer is also made of lightweight board. The glue problem is to provide enough area of contact of a glue bead between the side member and the two layers that comprise interior and exterior layers. By inserting a spacer between the exterior layer and the interior layer, the spacer being slightly smaller or scalloped around its edges a space or channel to receive glue is provided. This provides for an extended area of glue contact on the side member due to the thickness of the spacer and also an extended area of glue contact with the inner and outer members due to the space created by the reduced size or scalloping of the spacer.

It would be of considerable benefit if the requisite glue contact could be accomplished consistently over large volumes of box manufacture without the enlargement and extra cost (both materials and labor) caused by the spacer. The present invention provides a solution to the problem of strong glue contact without use of a spacer and allows automation for high volume production.

SUMMARY OF THE INVENTION

A candy box or a candy box cover is constructed with use of a fixture and glue injector by placing a side member in a fixture to form the shape of the box, placing an inner closure element inside the space defined by the side member and directing a glue injector around the interior angle formed by the side member and the inner closure member so as to create a glue fillet in contact with both the side member and the inner closure element. Then an outer closure element is placed over the inner closure element and slight controlled pressure is applied to compress the glue fillet so that a sufficient area of glue contact is established with both the side element and the two closure elements (the two closure elements together define a closure assembly).

Injection of the glue can be done by hand or by automated machine.

In another embodiment movement of the glue injector is controlled by a machine designed or programmed to maintain, to the extent possible, an angle of the glue injector for injection of glue to provide a glue fillet in a substantial portion of the interior angle.

If the angle between the side element and the closure assembly is 90°, as is very common, the desired angle is 45° plus or minus 20° and more preferably plus or minus 10°.

In another embodiment the machine is a programmable six axis machine for controlling movement of the glue injector.

In another embodiment the amount of glue injected is controlled to leave a glue layer after assembly and curing of the glue of a thickness of about twice the sum of the thickness of the inner and outer closure elements.

In another embodiment the angle for injection is allowed to vary from the middle of the interior angle by plus or minus about 20° and more preferable by plus or minus about 10°.

In another embodiment the glue injection is begun at a point on the inner closure element away from the intersection of the side element and the inner closure element and is then directed into the interior corner defined by the side element and the closure assembly.

In another embodiment the amount of glue injected is controlled to leave a glue layer after assembly and curing of the glue of the outer closure element of a width of at least about twice the sum of the thickness of the inner and outer closure elements.

In another embodiment the box and its cover are heart shaped and glue injection is begun near the point of the heart and the injector is directed into the interior corner a selected distance away from the point of the heart and the injection of glue is terminated a selected distance away from the point of the heart.

In another embodiment the amount of glue injected is controlled to leave a glue layer after assembly and curing of the glue of a width at least about three times the sum of the thickness of the inner closure element and the outer closure element.

In another embodiment the box or box cover is made with a side element defining an interior shape, and a closure element is placed in the space and glue is injected in the interior corner thus formed to form a glue fillet in which the glue fillet may extend all around the interior corner or may be applied as spaced-apart lengths of glue fillet placed according to a predetermined pattern of glue fillet lengths and spaces between them.

In a further embodiment, the interior corner may be on the outside of the box or it may be on the inside of the box.

In a further embodiment a second closure element may be put in place to have glue contact along with the side element and the first closure element. The second closure element will be an outside closure element when the interior corner is on the outside of the box and it will be an inside closure element when the interior corner is on the inside of the box

DETAILED DESCRIPTION

The content of U.S. Pat. No. 5,400,917 is incorporated by reference into this description. Although some of the wording used here to describe various parts and steps may be different from that used in the '917 patent, those skilled in the art will recognize the intended meanings and the commonality and distinctions.

Figure 1:
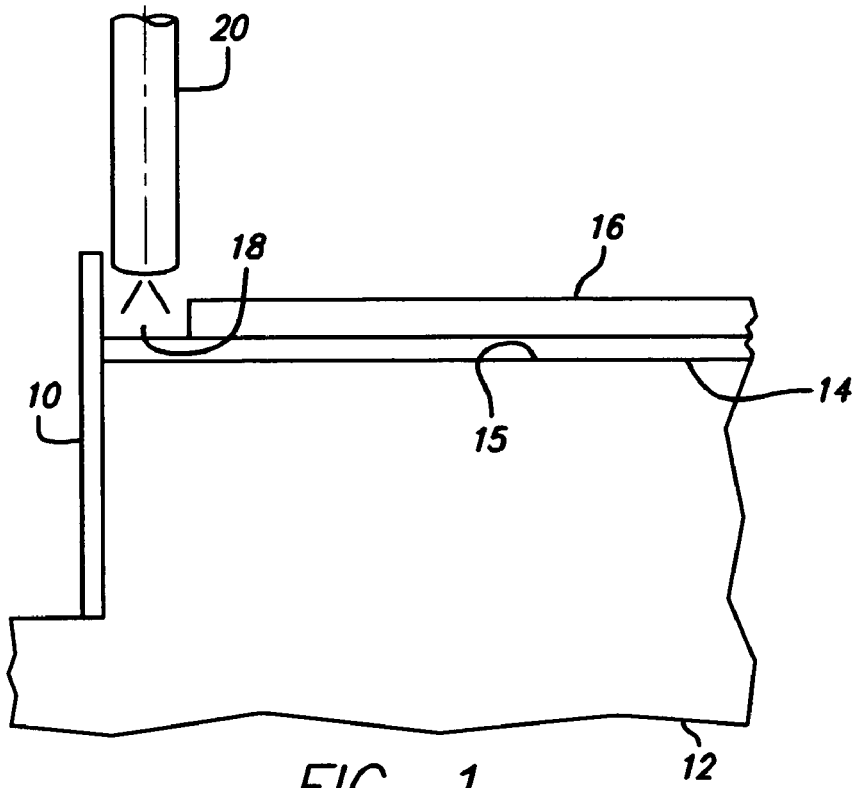
FIG. 1 PRIOR ART
FIG. 1 shows the prior art.

FIG. 1 shows how the prior art configuration and method works. A side element 10 is fitted around a fixture 12 and an inner closure element 14 is placed inside it on the fixture surface 15. Then a spacer 16 is placed on top of the inner closure element creating a channel 18. A glue injector 20 can be aimed at the channel and moved around the inside periphery of the box to fill the channel with glue. It is sufficient for this procedure to provide the glue injector 20 with movement in which it is always pointing straight downward. As described in the '917 patent this will provide a good glue attachment of the parts of the box because the spacer allows a sufficient amount of glue to bind to both the side element and the closure elements. With the spacer 16 in place the required control of the injector 20 is reduced because the glue only has to flow into the channel 18.

It is an important goal of the prior art and the present invention to get wide glue contact on the side element and on the inner closure element simultaneously. In the present invention this accomplished by depositing a glue fillet at the corner formed by the side element and the inner closure element. The optimum glue fillet is approximately symmetrical, that is, the contact area on the side element and on the inner closure element is about the same.

Figure 2:
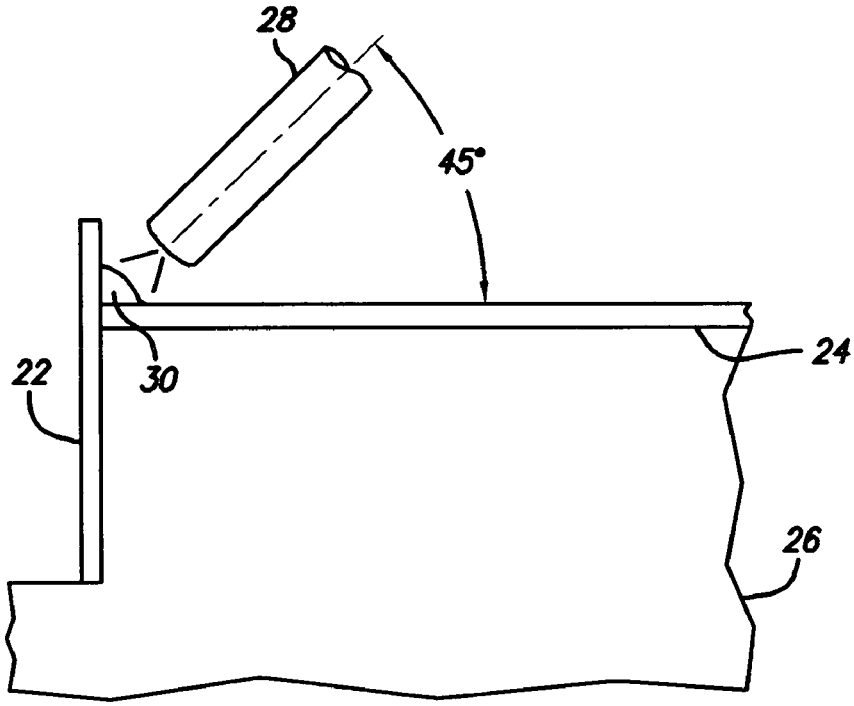
FIG. 2 shows the step of injecting glue.

FIG. 2 shows a side element 22 and an inner closure element 24 mounted in a fixture 26. A glue injector 28 is directed at the interior corner formed by the side element 22 and the inner closure element 24 so that the injected glue forms a fillet 30. The glue injector 28 is directed at an angle that is about one-half the angle formed between the side element 22 and the inner closure element 24. Most of the time the angle between the side element 22 and the inside closure element 24 is 90 degrees, so the desired angle of the glue injector 28 will be about 45° from vertical (or horizontal), where, as in this embodiment, the elements are vertical and horizontal respectively.

Figure 3A:
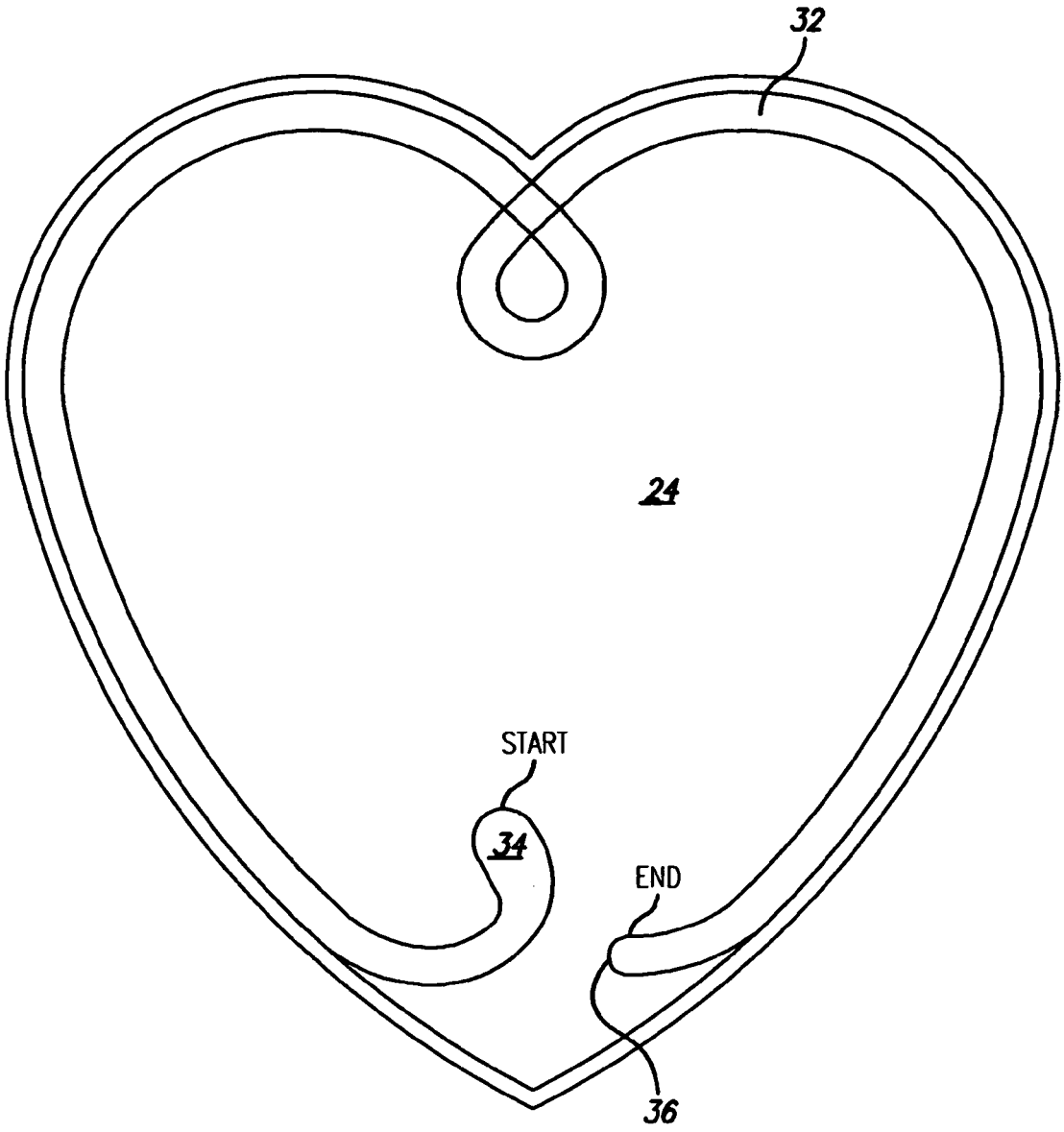
FIG. 3*a* shows a pattern of injected glue in a heart box construction.
Figure 3B:
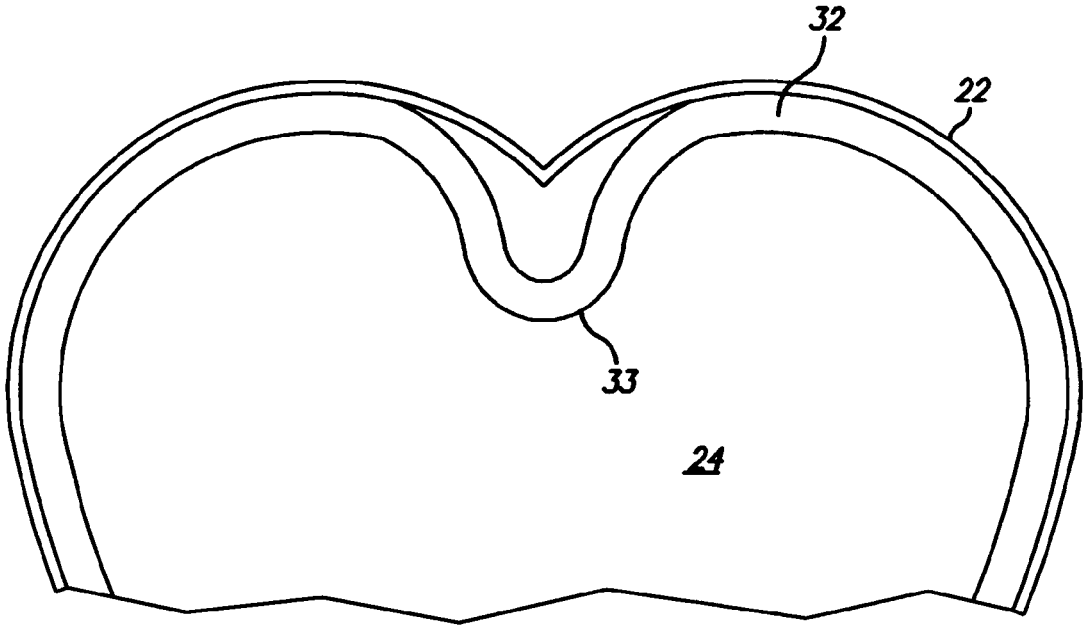
FIG. 3*b* shows an alternative pattern of glue injection in a heart box construction.

FIG. 3*a* shows a programmed glue injection pattern 32 for a heart shaped candy box having side element 22 and an inner closure element 24. The glue injection starts at 34 and ends at 36, which are both on the inner closure element 24 and spaced away from the interior corner. This is because at the start 34 of glue injection a larger amount of glue is deposited because the injector apparatus initially is not stabilized to the desired combined glue flow rate and injector movement. After stabilized glue flow is established the injector 28 moves to the interior corner and proceeds around the inner periphery. As seen in FIG. 3*a* at the intersection of the heart lobes the glue injector is moved through a circle because the machine cannot make a point turn while maintaining movement of the injector to keep the flow uniform, it has pause or slow down. At the end 36 there is also an enlarged blob of glue, for the same reason as the injector 28 stops. An alternative flow path is shown in FIG. 3*b* in which the glue injector follows a curved path 33 around the intersection of the heart lobes. For heart shaped candy boxes the crest of the heart lobes is a critical area because they tend to lift if not glued firmly and in particular if the glue does not set sufficiently before pressure is released.

The next step is to lay an outside closure element with controlled pressure on top of the inside closure element, compressing the glue fillet. The amount of compression on the glue fillet should be enough to flatten it so that there is a height (also called thickness) of glue contacting the side element at least equal to the thickness of the outer closure element. For most candy box sizes this means that the height of the glue on the side element after the outer closure element is laid down ranges from about one sixteenth inch to about one thirty-second inch. It is also best that the outer closure element be laid down by vertical placement, preferable not by rolling placement.

Figure 4:
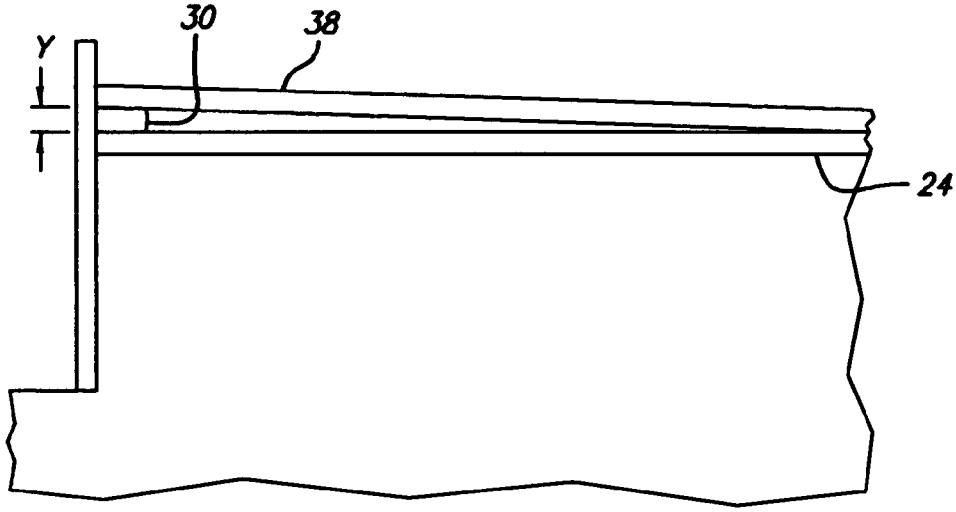
FIG. 4 shows the step of placing the outside closure member.

FIG. 4 shows an outer closure element 38 set down on top of the inner closure element 24 and compressing the glue fillet 30. A common glue thickness for fairly small size candy boxes is 0.020 in (about 1/32 in), that is, the desired height Y is about 1/32 in.

For larger boxes, it is desirable that the height of glue contact with the side element be about equal to the sum of the thickness of the inner closure element and the outer closure element.

Also, it is desirable that the width of the glue contact with the closure elements be at least about three times the sum of the thickness of the inner and outer closures.

Figure 5:
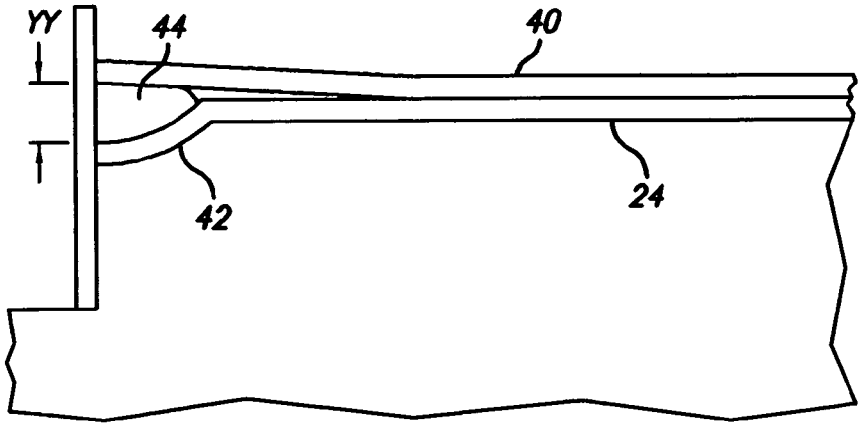
FIG. 5 shows an alternative form.

FIG. 5 shows an alternative configuration for use where a greater height of glue contact on the side element 22 is desired. In this case the inner closure element 40 is embossed around its periphery as at 42 to bend it away from the outer closure element 24. This creates a higher space YY so that the height of glue adhered to the side element 22 is greater. The embossment can be placed around the outer closure element but this would show on the exterior of the box and so is regarded as less desirable, although functionally it would work just as well.

In a preferred embodiment, to accomplish control of the glue injector, it is installed on a robotic device that has six axes of movement. A SV3 JRC Six Axis Robot coupled with a JRC Enhanced Teach Pendant made (or assembled and programmed) by MOTOMAN a Yaskawa company of West Carrollton, Ohio does the job nicely. This is implemented with WINCAPS Lite Software for efficient program development and management. However it is not necessarily the case that a six-axis device be used. A lesser number of axes of movement may suffice. The essential capability is to be able to keep the glue injector aimed into the interior corner formed by the side element and the inner closure element to form a good glue fillet. A good glue fillet is one that will retain its shape, that is, it will not flow before the outer closure element is installed. A glue fillet that is of equal height and length, that symmetrical, is understood to define a good glue fillet. This is accomplished by controlling the angle of the glue injector. In the case of 90-degree corners, which is nearly all of the cases, the 45-degree angle is the optimum. But a good glue fillet can be formed at 10° more or less from the 45° angle, and satisfactory glue fillet can be formed at 20° more or less from the 45° angle.

In the more general case, optimally, the glue injector should be directed at an angle that splits the angle formed between the side element and the inside closure element. If the actual angle is greater than 90 degrees, then an even greater divergence from the halfway angle can be used and still get a good glue fillet. But when the actual angle is smaller than 90 degrees the allowable range is decreased for the divergence toward vertical, although not for the divergence toward horizontal. Those skilled in the art will also appreciate that the size of the glue injector along with its proximity to the interior corner will play a role in the allowable angle of injection limiting the range of angle if it is so large as to interfere with the elements of the box.

Figure 6A:
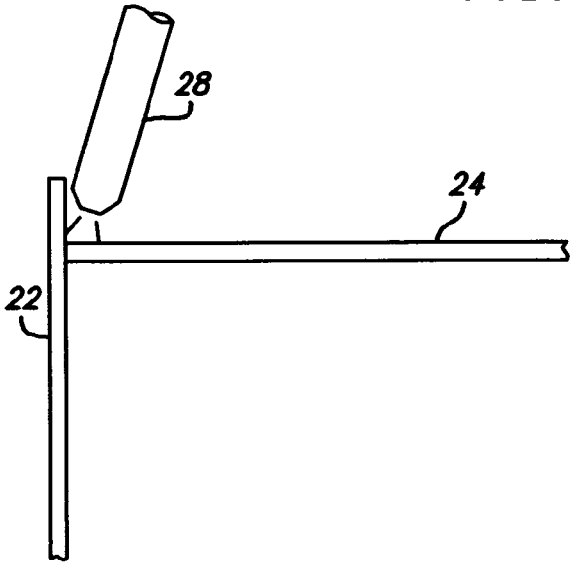
FIGS. 6*a* and 6*b* are schematic representations of glue injector angles.
Figure 6B:
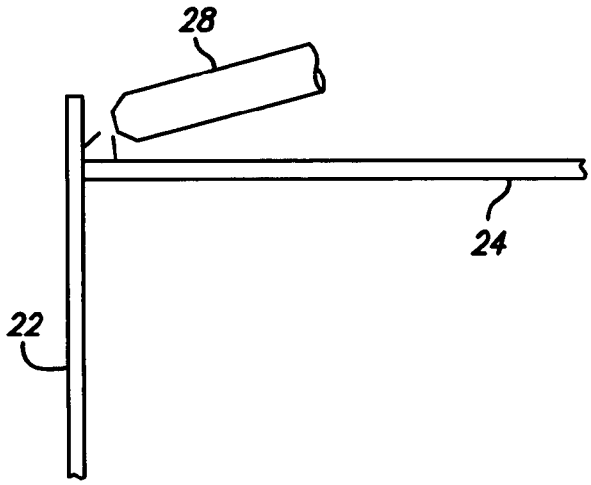

Further the allowable divergence of the angle toward horizontal is greater than that toward vertical. This is schematically illustrated in FIGS. 6*a* and 6*b* in which a reasonably good fillet, with some height on the side element is possible from a low, closer to horizontal, angle, but a high closer to vertical angle makes a good fillet less available, and to alleviate this problem the injector would have to traverse more slowly and more glue would have to used.

It can then be appreciated that if the interior angle is less than 90°, the divergence of the angle of the injector from the midpoint angle toward horizontal is not likely to be affected to give a good glue fillet. But, the allowable divergence from the midpoint angle toward vertical is likely to considerably affected.

In an alternative method the side element may be slightly roughened where the glue will contact it. This will give a stronger bond. A knurling roller can be used to accomplish this roughening.

While the foregoing description refers to a continuous fillet of glue in the interior corner; it is not necessary that such be the case. A discontinuous glue fillet may be deposited with spaces between lengths of the glue fillet. Therefore a glue fillet pattern is put down having lengths of glue fillet separated by spaces. It is possible and desirable to plan the glue fillet pattern to minimize the amount of glue used while obtaining the necessary strength for construction of the box. In one embodiment the glue fillet lengths will be about the same around the interior corner and the spaces between them will be about the same lengths or the spaces may be a different length than the glue fillets, in fact, it is preferable that the spaces be longer than the glue fillets. The glue fillet may be so short that it is regarded as and appears more like a glue spot, although it still should extent substantially up the side member as well as on the closure member, that is have the cross-sectional shape of a fillet. In other embodiments the glue fillet lengths and spaces may be designed to meet the particular needs of the box construction.

In the process of creating the box, in one embodiment, the side element is formed into the correct shape (such as a square, rectangle or heart shape for example) and is held in that shape by a fixture. A fixture may be inside or outside the area defined by the side element, or may have portions on both the inside and outside. Then the closure element is placed inside the side element at the desired point on the height of the side element. This may be done to leave a small dimension on the outside or it may be flush with the side element. Placement of the closure element can be controlled by a fixture that provides the desired point of placement on the height of the side element. Next glue is deposited. A second closure element can be put in place after the glue is deposited.

Figure 7:
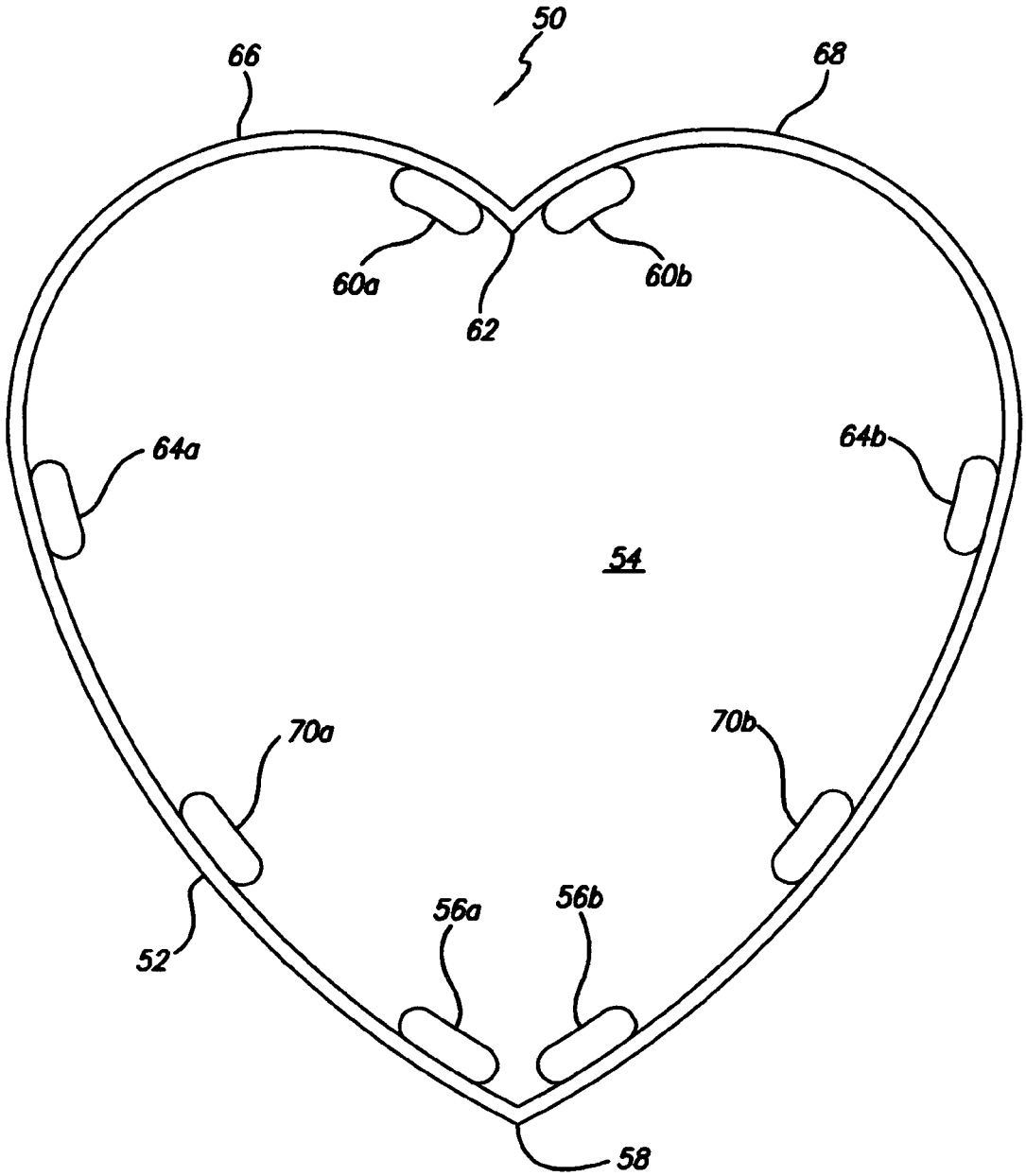
FIG. 7 shows an embodiment of the invention using spaced-apart glue fillets.

As seen in FIG. 7, for example, in the case of a heart box 50 having a side element 52 and a closure element 54, glue fillets 56*a*, 56*b* may be closely placed on each side of the heart point 58 (although one may do) and similarly at 60*a*, 60*b* on each side of the heart lobe cusp 62 (again, one may do), while elsewhere around its interior corner the glue fillets may be strategically placed such as at 64*a* and 64*b* 8 and at 70*a* and 70*b*. The goal is to use the least amount of glue necessary for strength and to prevent dislocation of the elements that make up the interior corner. It is generally desirable to make the glue fillet lengths substantially less than the unglued space between them. Glue requirements vary depending on the rigidity of the closure element; stiffer material requires less glue.

Figure 8A:
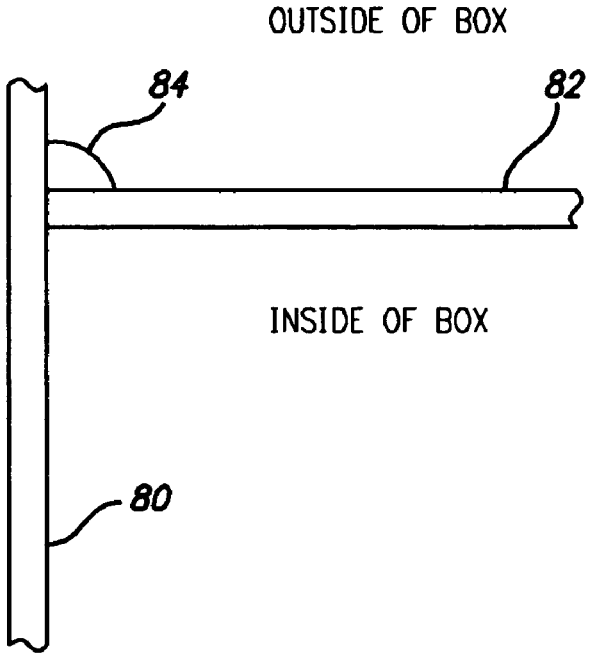
FIG. 8*a* shows an embodiment of the invention in which the interior corner is on the outside of the box.
Figure 8B:
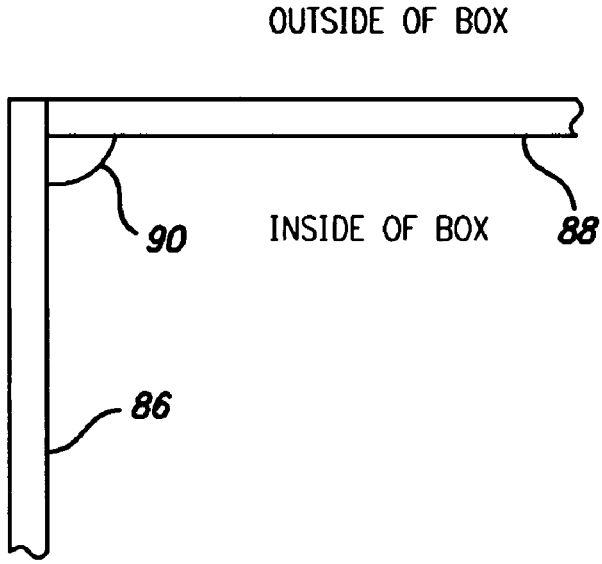
FIG. 8*b* shows an embodiment of the invention in which the interior corner is on the inside of the box.

With this type of construction a box can be made with only a single closure element as shown in FIGS. 8*a* and 8*b*. FIG. 8*a* shows a construction in which a side element 80 and a single closure element 82 are held together by glue fillets such as 84 being placed on the outside of the box (note that the corner is still regarded as an "interior corner" because it is inside the periphery of the side element). FIG. 8*b* shows a similar construction in which a side element 86 and a single closure element 88 are held together by glue fillets such as 90 being placed on the inside of the box (still, in an interior corner as defined).

Figure 9A:
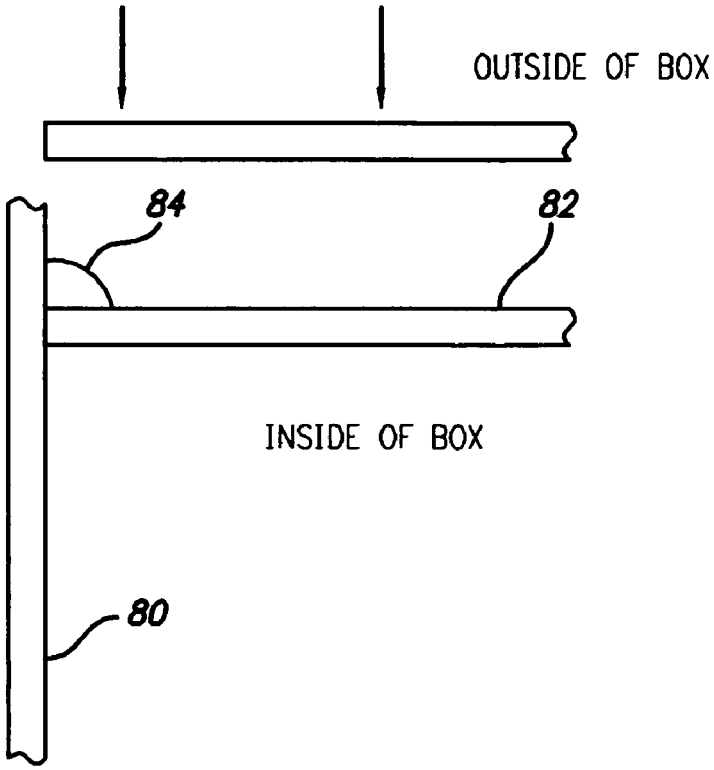
FIG. 9*a* shows an embodiment of the invention in which the interior corner is on the outside of the box and a second closure element is put in place to define an outside second closure element.

Nevertheless a two-piece closure construction as described above could be used. As shown in FIG. 9*a*, a second closure element 92 is put in place adjacent the closure element 82 (now defined as a first closure element), the second closure element 92 being on the outside of the box and defining an outside closure element in what is a two-layer closure assembly.

Figure 9B:
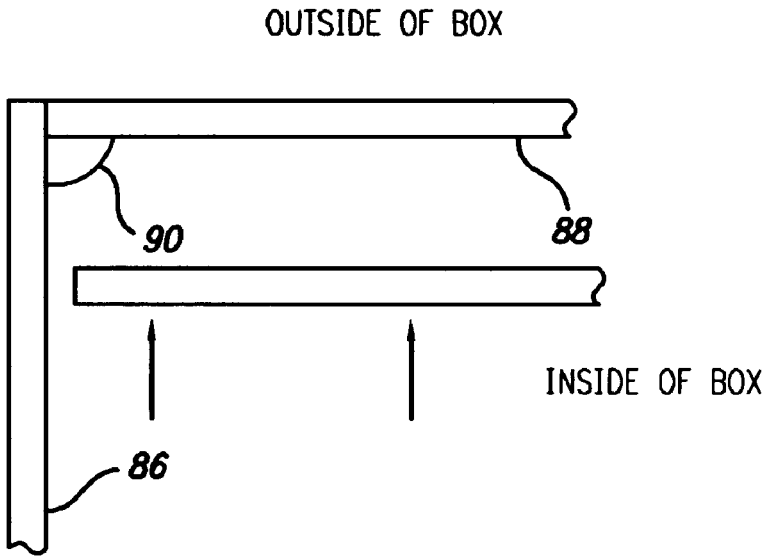
FIG. 9*b* shows an embodiment of the invention in which the interior corner is on the inside of the box and a second closure element is put in place to define an inside second closure element.

Similarly, a two-layer closure assembly is shown in FIG. 9*b* in which a second closure element 94 is put in place adjacent the closure element 88 (now defined as a first closure element), the second closure element being on the inside of the box and defining an inside closure element.

In the case of multi-layer closure assemblies, such as the two-layer closure assembly, described above, both of the closure elements are in contact with the glue fillet, as is the side element.

It can be further appreciated from the foregoing description that the present invention allows the use of a single glue application step. This is the case even if both an inner and outer closure members are used. Further, the assembly of a box having inner and outer closure members may implemented with either of them put in place first, the glue put in place in the interior corner and then the other closure member put in place. This will result, regardless of the order of assembly, with the inner and outer closure members held to both each other, and the side member with a single application of glue to form a glue fillet, whether continuous or spaced-apart, or in any planned pattern of glue fillet lengths and unglued space lengths.

Figure 10:
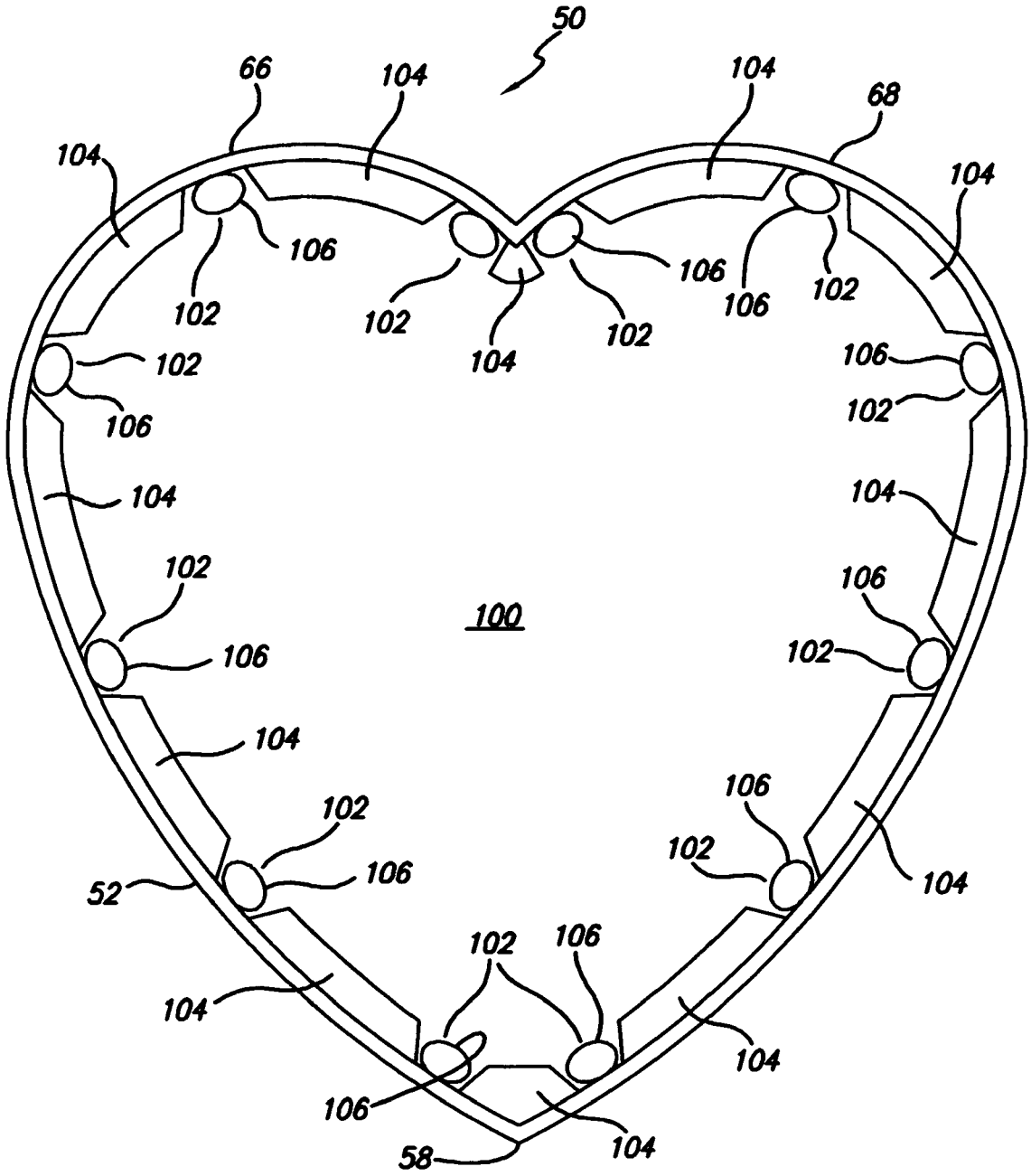
FIG. 10 shows an embodiment of the invention in which a closure element has tabs that extend to a side element, leaving spaces, and with glue bullets on the tabs, and spacing between the tabs.

In another embodiment, as shown in FIG. 10, a closure element 100 may have tabs 102 that extend to the side element 52 leaving spaces 104. Each tab 102 reeches the side element 52 and may have a glue fillet 106, or selected ones of the tabs 102 may have glue fillets. The tabs 102 can be of such size and spacing as is desired to accomplish the necessary strength for the box. Also, they may be of such shape and spacing as to provide a decorative result.

The application of glue can be done by hand or by automated machine. Where several point applications of glue are to be made, a manifold may be made in the appropriate shape to put injection outlets at the points in the box as desired for the pattern of glue fillets in the interior corner. Glue requirements vary depending on the rigidity of the side element; stiffer material requires fewer glue points.

While there are shown and described certain specific embodiments of the invention for the purpose of clarity of understanding and to describe the embodiments preferred in order to meet the requirements of the description of the invention; it will be manifest to those skilled in the art that changes modifications and rearrangements of the features may be made without departing from the spirit and scope of the underlying inventive concept and concepts and that the present invention is not limited to the particular forms herein shown and described except insofar as allowed by the scope of the appended claims and equivalents thereof.

What is claimed is:

1. A method of making a candy box or a cover for a candy box comprising;

assembling to a fixture a side element made of paper board material in which a portion of the fixture is shaped to cause the side element to take on the desired shape, an inside surface of the side element defining an interior space;

placing into the interior space a closure element which is shaped to conform to the shape of the inside surface of the side element and to fit such that at least selected portions are in contact with the side element the intersection of the side element and the selected portions of the closure element defining an interior corner formed around the inside periphery of the side element with the closure element wherein the interior corner is defined by the inside surface of the side element and the inside surface of the closure element;

injecting hot melt glue at a sufficient angle into the interior corner into direct contact with the side element and the closure element to create at least one glue fillet to affix the closure element to the side element absent any other element holding the side element and the closure element together and in which the glue is deposited by directing around a substantial portion of the interior space a glue injector while injecting glue from the glue injector in a manner to leave at least one glue fillet in the interior corner on the inside of the box.

2. The method of claim 1 in which the glue is deposited by injecting it from a manifold that has openings for glue injection at selected spaced apart positions.

3. The method of claim 1 in which glue is injected from a glue injector to form a plurality of spaced-apart glue fillets having spaces between them configured according to a predetermined pattern for the placement and length of the glue fillets and the length of the spaces.

4. The method of claim 1 in which the closure element is configured to have a plurality of spaced apart tabs in which the tabs extend to the side element to define an interior corner along each tab and a space between the tabs, and glue is deposited at the interior corners defined by the tabs and the side element.

5. The method of claim 1 in which the interior corner is defined by the inside surface of the side element and the outside surface of the closure element such that the at least one glue fillet is on the outside of the box.

6. The method of claim 1 in which the side member is heart shaped and defines a heart shaped interior space and the closure element is a heart shape congruent with the interior space.

7. The method of claim 6 in which the spaced-apart glue fillets include at least one glue fillet proximate the point of the heart and at least one glue fillet proximate the cusp of the lobes of the heart.

8. The method of claim 3 in which the closure element is a first closure element and a second closure element is placed over the first closure element so that the glue of the at least one glue fillet contacts the side element and both the first and the second closure elements.

9. The method of claim 5 in which the side member is heart shaped and defines a heart shaped interior space and the first and second closure elements are a heart shape congruent with the interior space.

10. The method of claim 8 in which the side member is heart shaped and defines a heart shaped interior space and the first and second closure elements are a heart shape congruent with the interior space.

* * * * *